US010889142B1

(12) United States Patent
Wang

(10) Patent No.: US 10,889,142 B1
(45) Date of Patent: Jan. 12, 2021

(54) ORGANIZER WITH AN INTERCHANGEABLE CLOSURE STRAP SYSTEM

(71) Applicant: Tiki Tianqi Wang, West Vancouver (CA)

(72) Inventor: Tiki Tianqi Wang, West Vancouver (CA)

( * ) Notice: Subject to any disclaimer, the term of this patent is extended or adjusted under 35 U.S.C. 154(b) by 0 days.

(21) Appl. No.: 16/439,442

(22) Filed: Jun. 12, 2019

(51) Int. Cl.
*B42F 13/26* (2006.01)
*B42F 13/40* (2006.01)

(52) U.S. Cl.
CPC ..... *B42F 13/26* (2013.01); *B42F 13/406* (2013.01); *B42P 2241/04* (2013.01)

(58) Field of Classification Search
CPC ..... B42F 13/26; B42F 13/406; B42P 2241/04
USPC .... 281/3.1, 4, 15.1, 17, 19.1, 21.1, 27.1, 29, 281/45; 283/63.1, 64; 402/4, 26, 31, 73, 402/74, 75, 76, 501, 502, 503
See application file for complete search history.

(56) References Cited

U.S. PATENT DOCUMENTS

| | | | | |
|---|---|---|---|---|
| 7,699,553 | B1 * | 4/2010 | Merzon | A45C 3/02 402/70 |
| 2003/0053850 | A1 * | 3/2003 | Cruz | B42D 5/006 402/73 |
| 2005/0218017 | A1 * | 10/2005 | Collins, IV | G11B 33/0422 206/308.1 |
| 2007/0114783 | A1 * | 5/2007 | Glosh | B42D 3/00 281/29 |
| 2013/0099472 | A1 * | 4/2013 | Quehl | B42D 3/00 281/29 |
| 2014/0064823 | A1 * | 3/2014 | Benefield | A45C 11/00 402/4 |
| 2016/0023499 | A1 * | 1/2016 | Tanaka | B42F 13/20 402/29 |

* cited by examiner

*Primary Examiner* — Justin V Lewis
(74) *Attorney, Agent, or Firm* — Plager Schack LLP

(57) ABSTRACT

A device for storing and transporting personal items where the device has a folder; a plurality of slots on a first side of the folder; and a strap wherein the strap comprises a first strap end that is inserted through an individual slot of the plurality of slots and a second strap end configured to have an anchor so that the strap stops before going completely through the individual slot and inserting the strap through an individual slot expands or condenses a size capacity of the folder while the strap is secured to the folder.

11 Claims, 3 Drawing Sheets

ORGANIZER WITH AN INTERCHANGEABLE CLOSURE STRAP SYSTEM

BACKGROUND

The embodiments herein relate generally to organizers, and more particularly a notebook with an interchangeable closure strap system for notebook size customization. Planners, notebooks, journals, diaries, wallets and portfolios are common items used by people though out their day and are often times represented as flat foldable holders, herein referred to as folders. These folders are used for day to day activities requiring some form of personal document retention or record keeping. Some of these folders come with a strap or tab that helps secure the folder and its contents.

These folders are limited in size and capacity by the strap or tab that helps secure the folder and its contents. As a user places more and more items in the folder such as cards, money, currency, papers, receipts, writing utensils and other daily use items, the folder will reach its limit causing it to be ineffective for the user. This can possibly result in the user having to purchase a new folder, wasting money or remove items which will be needed at a later time.

Therefore, what is needed is organizer with a removable and adjustable closure strap for expanding the size and usefulness of the folder.

SUMMARY

A device for storing personal items, the device comprising; a folder; a plurality of slots on a first side of the folder; and a strap wherein the strap comprises a first strap end that is inserted through an individual slot of the plurality of slots and a second strap end configured to have an anchor so that the strap stops before going completely through the individual slot and inserting the strap through an individual slot expands or condenses a size capacity of the folder while the strap is secured to the folder.

BRIEF DESCRIPTION OF THE FIGURES

The detailed description of some embodiments of the invention will be made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

Figure 1:
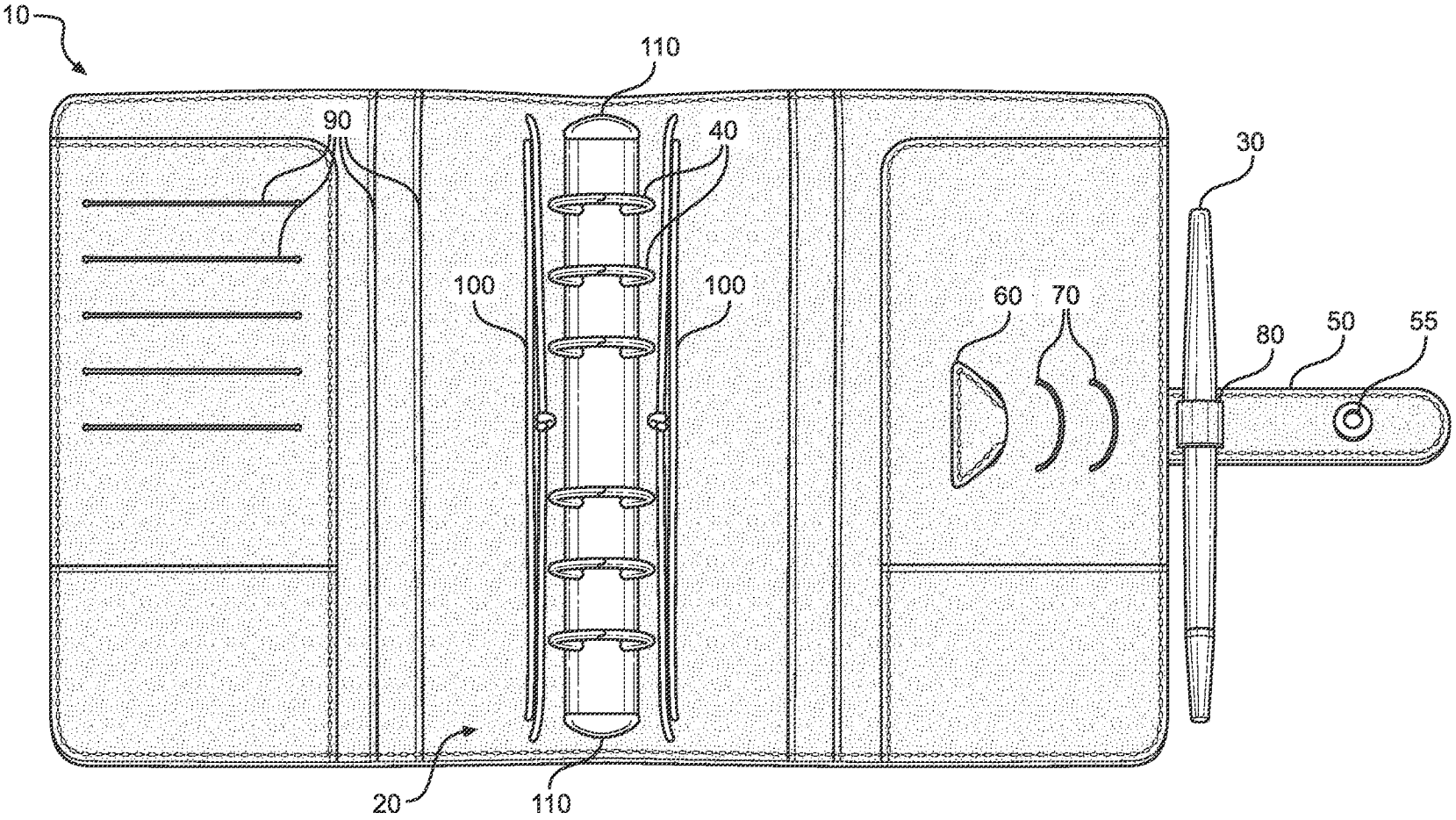
FIG. 1: is a perspective view of one embodiment of the present disclosure in use.
Figure 2:
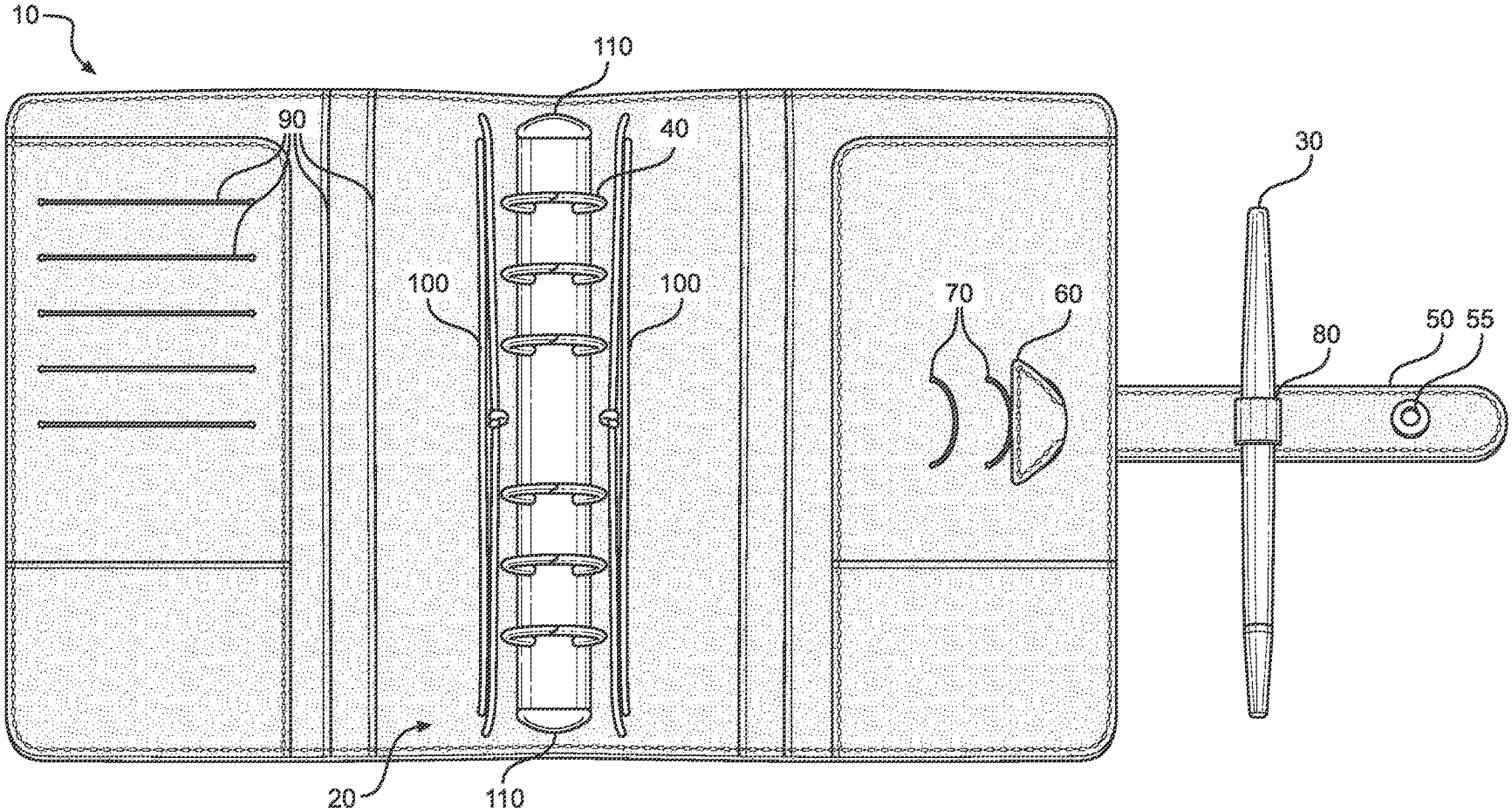
FIG. 2: is a perspective view of one embodiment of the present disclosure in use.
Figure 3:
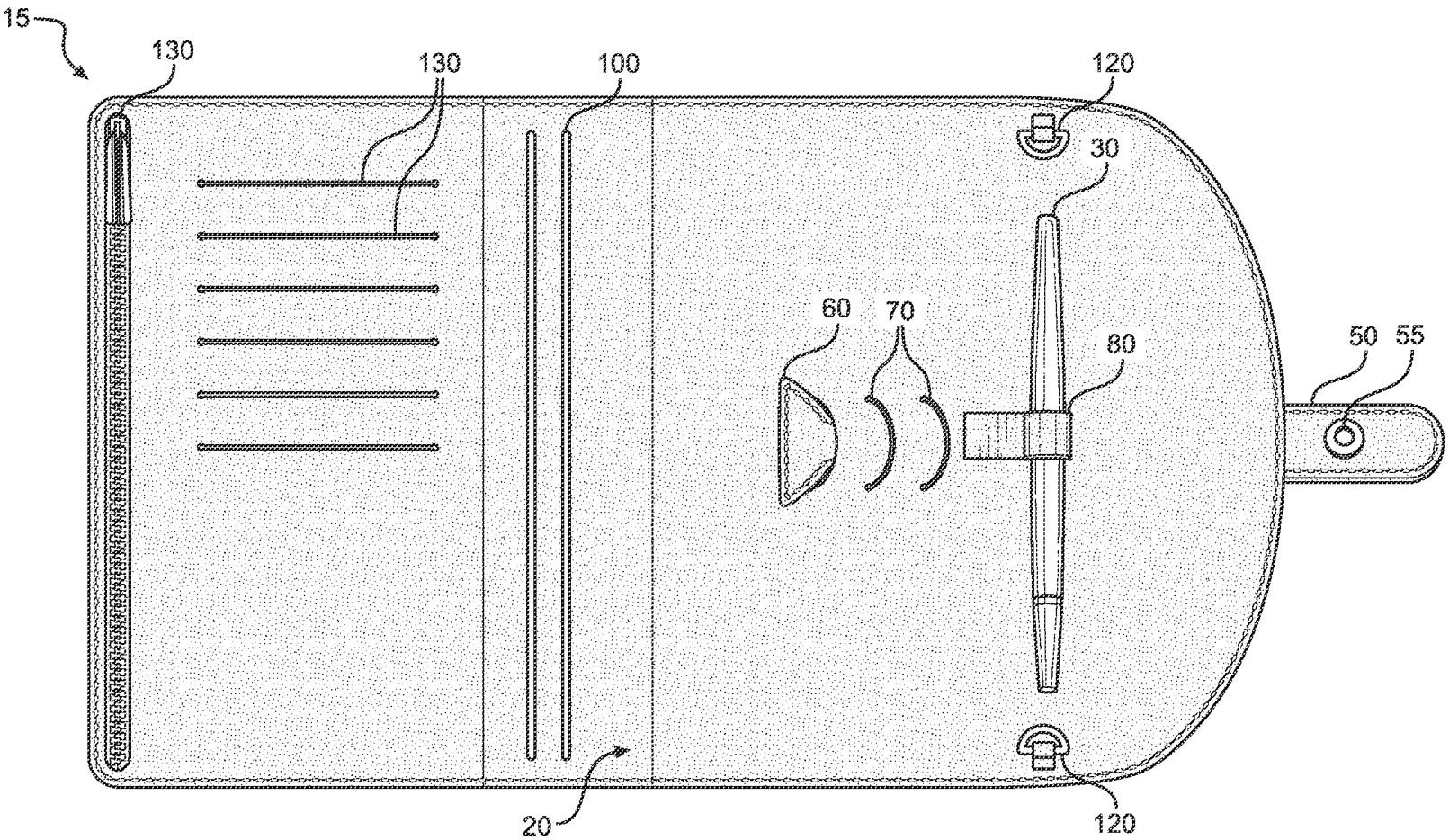
FIG. 3: is a perspective view of an alternative embodiment of the present disclosure in use.

By way of example, and referring to FIGS. 1-2, some embodiments of the present disclosure includes a device for storing and transporting personal items, such as a personal organizer with a removable and adjustable strap allowing the organizer to expand or compress in contents capacity 10 and alternative device 15 in FIG. 3. In some embodiments, the device 10 and alternate device 15 is a folder 20. In alternative embodiments, the folder 20 is selected from the group consisting of a notebook, a wallet, a journal, a diary, a planner, an organizer, a pocket book, a case, a clutch and a portfolio.

In some embodiments and referencing FIG. 1-3 the device 10 and alternate device 15 comprises a plurality of slots 70. In alternative embodiments, the plurality of slots 70 are configured to receive a strap 50. In some embodiments, the strap 50 is configured to have an anchor 60. In alternative embodiments, the anchor 60 keeps the strap 50 from passing completely through the plurality of slots 70. In some embodiments, to expand or compress the capacity size of the device, the strap 50 is moved to a different slot of the plurality of slots 70 (FIG. 1-2) depending on the needs of the user. In alternative embodiments, the strap 50 is exchanged for a different strap for customization or aesthetic purposes. In some embodiments, the strap 50 further comprises a loop holder 80 for a writing utensil 30 (FIG. 1, 2). In alternative embodiments and referencing FIG. 3, the loop holder 80 is attached to the folder 20 to hold the writing utensil 30.

In some embodiments and referencing FIGS. 1-3, the strap 50 of device 10 and alternate device 15, is configured to have a connector system 55. In alternative embodiments, the connector system 55 secures the strap 50 to an outer side of the folder 20 holding the device 10 is in a folded configuration. In some embodiments, the connector system 55 further comprises a plurality of components were a first component is attached to the strap 50 and a second component is attached to folder 20 so that the strap 50 is temporarily attached to the folder 20 by connecting the first component and the second component. In some embodiments, the connector system 55 is a snap system. In alternative embodiments, the connector system 55 is a clasp system. In some embodiments, the connector system 55 is a magnet system.

In some embodiments and referencing FIGS. 1-3, the device 10 and alternate device 15 further comprises at least one pocket 90. In alternative embodiments, the at least one pocket 90 is configured in a variety of ways to provide a variety of pockets to hold a variety of items such as business cards, credit cards, and papers. In some embodiments and referencing FIG. 3, the at least one pocket 90 is further configured to be at least one zipper pocket 130.

In some embodiments and referencing FIG. 1-2, the device 10 is configured to have a plurality of binder rings 40. In alternative embodiments, the plurality of binder rings are configured to have at least one binder tab 11 where the at least one binder tab 11 is operatively configured to open and close the plurality of binder rings 40. In some embodiments and referencing FIG. 3, the device 10 is configured without a plurality of binger rings In alternative embodiments and referencing FIGS. 1-3 the device 10 and alternate device 15 further comprise at least one stretch cord 100 wherein the at least one stretch cord holds paper in place. In some embodiments, the at least one stretch cord 100 comprises an elastic cord. In alternative embodiments, the at least one stretch cord 100 is a bungie cord.

In some embodiments and referencing FIG. 3, the alternate device 15 further comprises at least one purse strap loop 120, wherein a purse strap is attached to the at least one purse strap loop 120.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A device for storing and transporting personal items, the device comprising:

a folder having a first cover foldably attached to a second cover;

a plurality of slots extending through the first cover of the folder; and a strap removably engageable with each individual slot of the plurality of slots, wherein:

the strap comprises a first strap end designed to be inserted through the individual slot of the plurality of slots and extend outward therefrom, defining a free end that removably engages with the second cover and a second strap end comprising an anchor designed to prevent the strap from completely passing through the individual slot; and the anchor has a greater width than a width of the slot.

2. The device of claim 1, further comprising a connector system where a first part of the connector system is attached to the second cover of the folder and a second part of the connector system is attached to the first end of the strap allowing the first end of the strap to be secured to the second cover of the folder.

3. The device of claim 1, further comprising at least one pocket attached to the folder.

4. The device of claim 3, wherein the at least one pocket further comprises a zipper pocket.

5. The device of claim 1, further comprising a plurality of binder rings.

6. The device of claim 5, wherein the plurality of binder rings further comprises at least one tab for opening and closing the binder rings.

7. The device of claim 1, further comprising at least one stretchable cord wherein the at least one cord is configured hold paper.

8. The device of claim 1, further comprising at least one purse strap loop wherein a purse strap is attached to the at least one purse strap loop.

9. The device of claim 1, further comprising a loop holder attached thereto, the loop holder being sized to accommodate a writing utensil.

10. The device of claim 9, wherein the loop holder is attached to the strap.

11. The device of claim 9, wherein the loop holder is attached to the folder.

* * * * *